US007770311B2

(12) United States Patent
Hahnel

(10) Patent No.: US 7,770,311 B2
(45) Date of Patent: Aug. 10, 2010

(54) MOUNTING SYSTEM FOR EXCAVATION BUCKETS AND IMPLEMENTS

(76) Inventor: Craig Arthur Hahnel, 5/4 Rockley Road, South Yarra (AU) 3141

( * ) Notice: Subject to any disclaimer, the term of this patent is extended or adjusted under 35 U.S.C. 154(b) by 0 days.

(21) Appl. No.: 12/158,277

(22) PCT Filed: Dec. 19, 2006

(86) PCT No.: PCT/AU2006/001933

§ 371 (c)(1),
(2), (4) Date: Nov. 19, 2008

(87) PCT Pub. No.: WO2007/070941

PCT Pub. Date: Jun. 28, 2007

(65) Prior Publication Data

US 2009/0071043 A1 Mar. 19, 2009

(30) Foreign Application Priority Data

Dec. 20, 2005 (AU) ..... 2005907177

(51) Int. Cl.
*E02F 3/96* (2006.01)
*E02F 3/40* (2006.01)
*E02F 3/00* (2006.01)

(52) U.S. Cl. ..... 37/468; 37/403; 37/444; 414/723

(58) Field of Classification Search ..... 37/468, 37/414, 723, 444, 403; 403/4, 321, 322.1, 403/96; 414/723
See application file for complete search history.

(56) References Cited

U.S. PATENT DOCUMENTS 4,283,157 A * 8/1981 Kowalski ..... 403/297
4,836,741 A * 6/1989 St. Louis et al. ..... 414/723
5,382,110 A * 1/1995 Perotto et al. ..... 403/322.3
5,692,852 A * 12/1997 Collins ..... 403/234
5,791,863 A * 8/1998 Droegemueller ..... 414/723
5,927,665 A * 7/1999 Grabnic ..... 248/200
5,975,604 A * 11/1999 Wolin et al. ..... 294/88
6,158,950 A * 12/2000 Wilt et al. ..... 414/723
6,364,561 B1 * 4/2002 Droegemueller ..... 403/4

(Continued)

FOREIGN PATENT DOCUMENTS

AU 2004201141 A1 10/2004

(Continued)

*Primary Examiner*—Thomas B Will
*Assistant Examiner*—Abigail A Risic
(74) *Attorney, Agent, or Firm*—Katten Muchin Rosenman LLP

(57) ABSTRACT

A mounting system for excavator attachments or implements (10) having a pair of spaced mounting ears (12, 13) extending from implement includes a mounting pin receptor (19) engaged in each of at least one aligned pair of holes (14, 16) in the ears (12, 13), the pin receptors (19) each having an eccentric pin receptor hole (23) adapted to receive one of the mounting pins (17, 18). The pin receptors (19) are rotatable about their axes to vary, relative to the ears (12, 13), the position of the engaged mounting pin (17, 18). A locating plate (24) engaged with the mounting pin (17, 18) has one or more locating surfaces (32) to engage a cooperating surface on the ears or the attachment. The locating surfaces (32) and their engagement with the cooperating surfaces determines the relative position of the mounting pin (17, 18) engaged with the pin receptor holes (23).

21 Claims, 4 Drawing Sheets

U.S. PATENT DOCUMENTS

| | | | | |
|---|---|---|---|---|
| 6,533,529 | B2 * | 3/2003 | Waggoner | 414/723 |
| 6,718,663 | B1 * | 4/2004 | Geraghty | 37/468 |
| 6,811,371 | B2 * | 11/2004 | Mantovani | 414/723 |
| 6,938,514 | B1 * | 9/2005 | Crane et al. | 74/571.1 |

FOREIGN PATENT DOCUMENTS

| | | | |
|---|---|---|---|
| CA | 2234893 | A1 | 10/1999 |
| WO | 1999006317 | A1 | 2/1999 |
| WO | 2001083894 | A1 | 11/2001 |
| WO | 2003069077 | A1 | 8/2003 |

* cited by examiner

MOUNTING SYSTEM FOR EXCAVATION BUCKETS AND IMPLEMENTS

FIELD OF THE INVENTION

This invention relates to a mounting system for excavator buckets and other implements and equipment and relates particularly to a mounting system to facilitate the mounting of a variety of buckets or other equipment with non-uniform attachment points on various makes of excavators.

BACKGROUND OF THE INVENTION

The invention will be described with particular reference to its application to the mounting of an excavator bucket to the operating arm of an excavator. It will be appreciated by those skilled in the art, however, that the invention has applicability to the mounting of other forms of implements or attachment to the operating arm of excavators or other earthmoving equipment.

The most common form of mounting to connect an excavator bucket to the operating arm of the excavation machine utilises a pair of spaced mounting pins extending between a pair of substantially parallel ears which constitute part of the bucket. The mounting pins are engaged by an attachment on the end of the operating arm of the excavator whereby the bucket is locked to the arm and is able to pivot about the axis of one of the mounting pins, under the influence of an hydraulically or electrically actuated lever to change the bucket aspect.

A difficulty with mounting excavator buckets to the arms of excavators is that the dimensions of the ear width (spacing), pin diameter and pin spacing varies between manufacturers. In some cases, these dimensions also vary within a manufacturer, for machines of different capacities. Thus, a Caterpillar 312C excavator has an ear width of 221 mm, a pin spacing (centre to centre) of 407 mm and pin diameters of 65 mm. However, the equivalent class Komatsu excavator has an ear width of 261 mm, a pin spacing of 375 mm and pin diameters of 60 mm. A Sumitomo SH120 machine has an ear width of 235 mm, a pin centre spacing of 385 mm and pin diameters of 65 mm.

Accordingly, with present mounting systems, it is not possible to mount a bucket manufactured for one machine to the excavator arm of a different manufacturer.

This, therefore, requires machine owners and users to have a large range of substantially identical buckets for machines of different manufacturers. This is both highly inefficient, time consuming and wasteful of resources.

The specification published under International Publication No. WO 01/83894 A1 discloses one proposed arrangement to attempt to obviate difficulties of present mounting systems. The specification discloses the use of bushes that engage through enlarges holes in the ears, or side plates, of the implement mounting. Each bush has an eccentrically positioned hole to receive a mounting pin. The position of the pin relative to the side plates is adjustable by relative rotation of each bush. A plurality of locating screws located the bushes in desired positions. With this arrangement, the relative position of the respective pins is limited to the spacing of the locating screws. Further, in the dirty, dusty, rough environment in which the implements are used, screws and locating pins are difficult to use. Also, the provision of many locating screws reduces the structural strength of the side plates.

Similar problems exist with the structure disclosed in International Publication No WO 03/069077 A1, whereas the disclosure in specification WO 99/06317 provides only limited adjustment of the relative positioning of the pins.

It is therefore desirable to provide a bucket mounting system which obviates, to a large extent, the disadvantages to which reference is made above.

It is also desirable to provide a bucket mounting system which enables buckets of one manufacturer to be mounted to the machine arm of a different manufacturer.

It is also desirable to provide a bucket mounting system which is simple and easy to use, which can accommodate a variety of different mounting arm dimensions, and which is simple and quick to use.

It is also desirable to provide a mounting system for excavator buckets and other equipment which is economic to manufacture and use.

SUMMARY OF THE INVENTION

According to one aspect of the invention there is provided a mounting system for excavator attachments or implements which have a pair of spaced mounting ears extending from the attachment, the ears having aligned holes in each ear to receive axially spaced, parallel mounting pins adapted to be engaged by an excavator operating arm, the system including a pin receptor engaged in each of at least one aligned pair of holes, the pin receptors each having an eccentric pin receptor hole to receive a respective one of the mounting pins therethrough when the pin receptor holes are aligned, the pin receptors being rotatable about their axis to thereby vary the position of an engaged mounting pin relative to the ears, and a locating plate engagable with the said mounting pin and with one or more locating surfaces on the attachment or on one of the ears.

The system of the invention enables the pin receptors engaged in each of one pair of aligned holes to be rotated about their axis thereby moving a mounting pin engaged through the eccentric pin receptor holes, when aligned, about the axis of the pin receptors thereby moving the centreline of the engaged mounting pin towards and away from the centreline of the other mounting pin. With this arrangement, the spacing of the pins is able to be easily adjusted by rotation of the pin receptors. At the same time, the locating plate in engaged with the respective mounting pin and with locating surfaces on the ears or on the attachment to lock the respective mounting pin in the selected position.

The aligned holes to receive the pin receptors are enlarged compared with the size of hole otherwise required to receive a mounting pin.

In one embodiment, at least one locating plate is engaged with the two mounting pins, the locating plate having holes or slots to closely engage the mounting pins to thereby lock them in a predetermined spaced relationship to corresponds with the desired position to receive an excavator arm from a particular machine. In one arrangement, a pair of locating plates are provided, one being located adjacent each ear of the attachment.

It will be understood that a plurality of different locating plates will be required, each having the respective spacings between the pin holes or slots and the locating surfaces that correspond with the pin spacings and positioning required of different machine manufacturers. Further, the locating plates may have different thicknesses to account for different widths of arm mounting structures and ear spacings.

To enable an attachment to be used with a variety of different machines, the pin diameter may also be varied by using different eccentric pin receptors with pin receptor holes of different diameters and/or by providing a changeable sleeve bush on the pin receptor and/or on other pin mount so that pins of a different diameter may be fitted to the ears.

The pin receptors may be further locked or located in a desired angular position by a bolt or the like passing through a hole in the receptor having its axis parallel with the pin receptor hole axis, the bolt being adapted to engage through a corresponding hole in the locating plate. Thus, the pin receptor and the locating plate are locked together.

The locating plate may also have one or more holes adapted to align with corresponding holes in the respective ear to receive bolts or the like to secure the locating plate to the ear in the required position. An implement arm spacer may also be fastened to the ear and the locating plate by the bolts when an engaging implement arm or attachment has a transverse dimension substantially less than the ear spacing.

The locating surfaces on the attachment or on the ears may include edge surfaces of one or both of the ears. In this case, the locating plate is formed with at least one transversely extending flange to engage the ear edge.

In another arrangement, the edge of the ear is formed with a recess to receive a reversely turned rib or projection extending from a transverse flange on a locating plate.

In order that the invention is more readily understood, embodiments thereof will now be described with reference to the accompanying drawings.

DESCRIPTION OF EMBODIMENTS OF THE INVENTION

Figure 2:
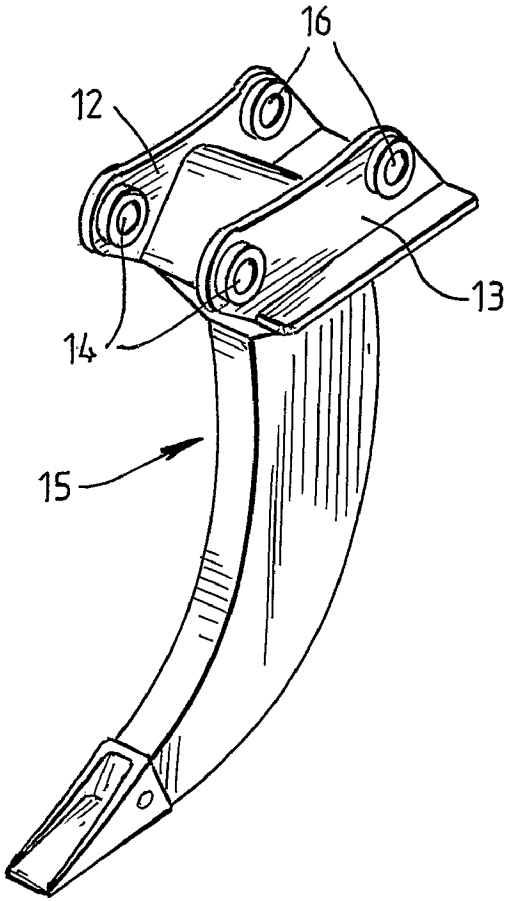
FIG. 2 is a view of a ripper tine incorporating mounting ears of a similar structure as those of the bucket of FIG. 1.
Figure 1:
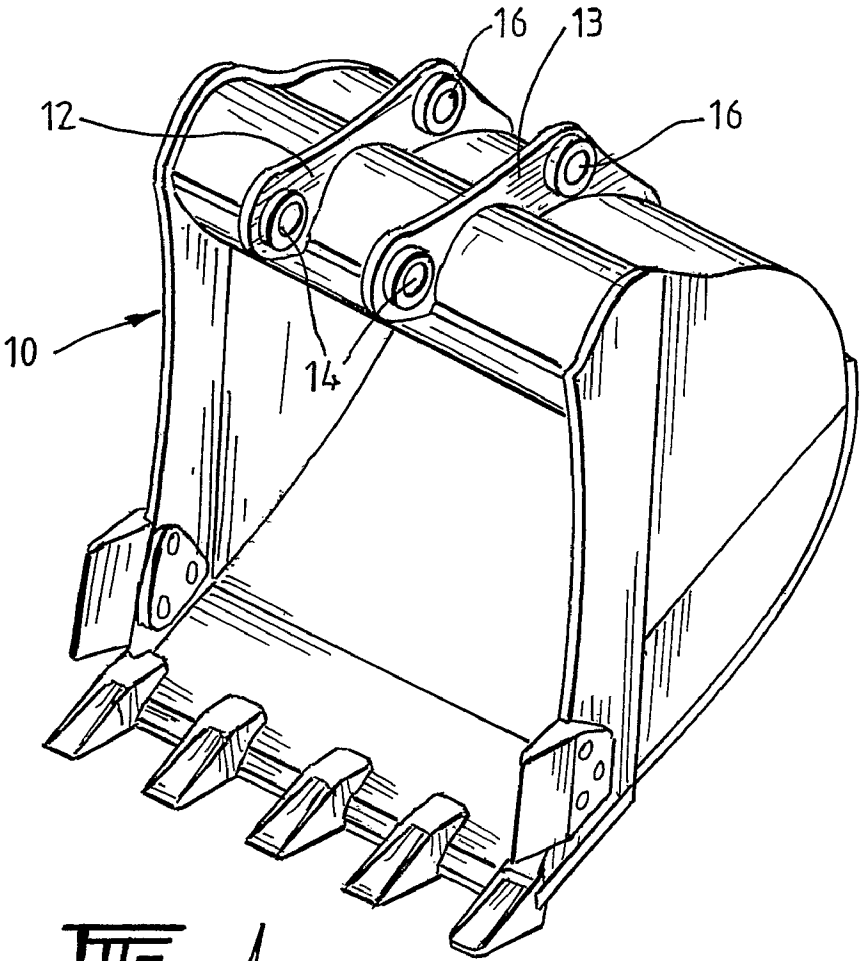
FIG. 1 is a perspective view of an excavator bucket of the type for which the invention is to be used.

Referring to the drawings, an excavation bucket 10 is shown in FIG. 1, and a ripper tine 15 is shown in FIG. 2, both implements incorporating a pair of mounting ears 12 and 13. With a standard mounting system, the end of an excavator arm is connected to the ears 12 and 13 by a pair of parallel pins which engage through the aligned holes 14 and 16 in the pair of ears 12, 13. A hydraulically operated linkage connecting the excavator arm to the rear pin, through holes 16, enables the implement to be pivoted about the front pin.

Figure 3:
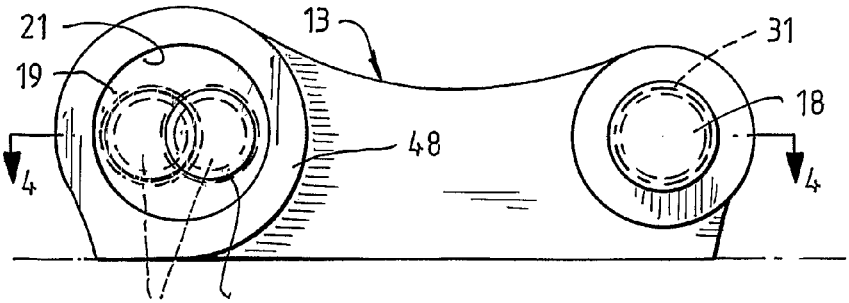
FIG. 3 is a side elevational view of the bucket ears incorporating one embodiment of the invention.

FIG. 3 illustrates one form of mounting system in accordance with embodiments of the present invention. In this embodiment, the ears 12, 13 are both formed at one end with an enlarged opening or hole 21, 22, and a pin receptor 19 engages within each enlarged hole 21, 22. Each pin receptor 19 has an eccentric pin receptor opening 23 to receive the mounting pin 17 when the openings 23 are substantially aligned.

With this arrangement, by rotating each pin receptor 19 about its axis, the axis of the pin opening 23 rotates about the axis of the pin receptor 19. In this way, the relative position of the pin 17 is able to be varied, and the distance between the axis of the pins 17 and 18 is able to be changed by twice the offset distance of the axes of the pin receptor 19 and the pin receptor opening 23. Thus, the pin centre-to-centre distance can be varied by rotation of the pin receptors 19 to take account of excavator arm mounting points of different excavators.

It will be appreciated that pin receptors 19 may also be used to locate the pin 18 such that the relative position of the pin 18 may be varied relative to the ears 12 and 13.

To ensure that the desired relative rotational position of the pins 17 and 18 is maintained, a locating plate 24, such as those shown in FIGS. 5 to 13, is engaged with one of the pins 17 or the pair of pins 17 and 18. The locating plate 24 of FIG. 5A has one pin opening or hole 23 whereby the plate 24 is engaged on the pin 17 between the ears 12 and 13. The plate has a locating edge or surface 32 adapted to abut the upper surface of the attachment 10 between the ears 12 and 13 whereby the abutment locates the position of the pin 17 relative to the ears 12 and 13. Because of the shape and dimensions of the locating plate 24, any tendency for the pin receptor to rotate about its axis is resisted by the contact of the locating surface 32 with the attachment 10.

A second locating surface 32*a* may also be provided on the edge of the locating plate 24, which surface 32*a* is adapted to engage an edge of a spacer block 40 mounted to the respective ears 12 and 13 by attachment bolts or other fasteners 45 (FIG. 4) to provide a desired spacing for an excavator arm that has a transverse dimension substantially less than the dimension between facing surfaces of the locating plates 24, when in position. Such spacer blocks 40 are preferably provided on both ears 12 and 13 to centralise the excavator arm.

Figure 5A:
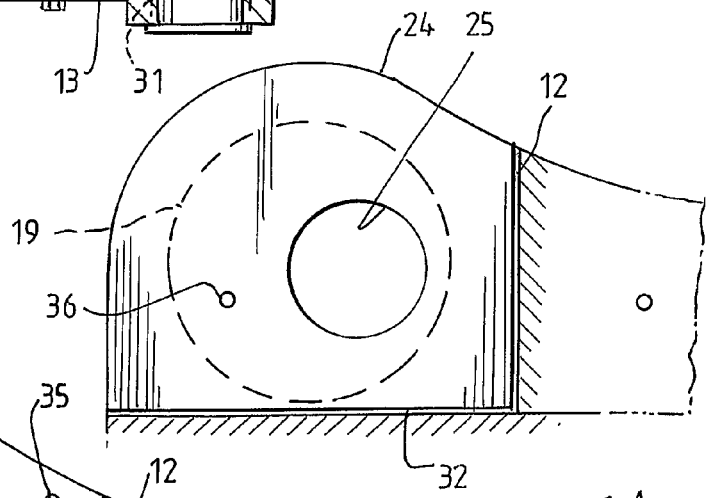
FIG. 5A is an elevational view of one embodiment of locating plate engagable with one of a pair of mounting pins.

The locating plate 24 of FIG. 5A has a locking hole 36 adapted to be aligned with a corresponding hole 34 in the pin receptor 19 spaced from the axis thereof. The holes 34 and 36, when aligned, are adapted to receive a bolt or other fastener to lock the pin receptor 19 to the locating plate 24. With this arrangement, the pin receptor 19 is prevented from moving, ie., rotating about its axis, and the locating plate 24 is prevented from rotational movement by the inter-engaged locating surfaces 32 and 32*a*.

Figure 5B:
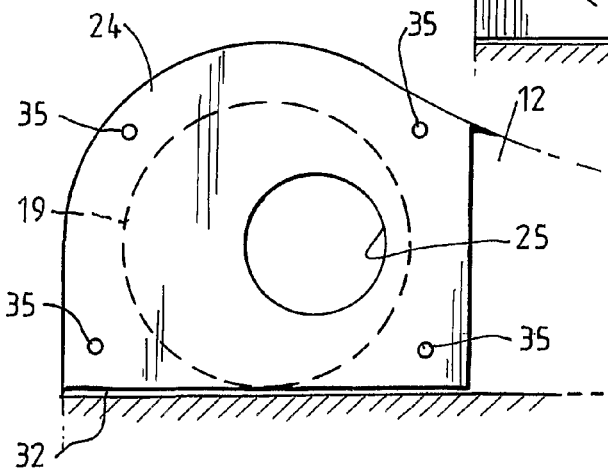
FIG. 5B is an elevational view of another embodiment of locating plate engagable with one of a pair of mounting pins.

The variation of locating plate 24 shown in FIG. 5B omits the locking hole 36 but incorporates alternate holes 35 adapted to receive bolts or other fasteners, pins or restrainers (not shown) to prevent rotation of the locating plate relative to the respective ear 12 and 13.

Figure 6:
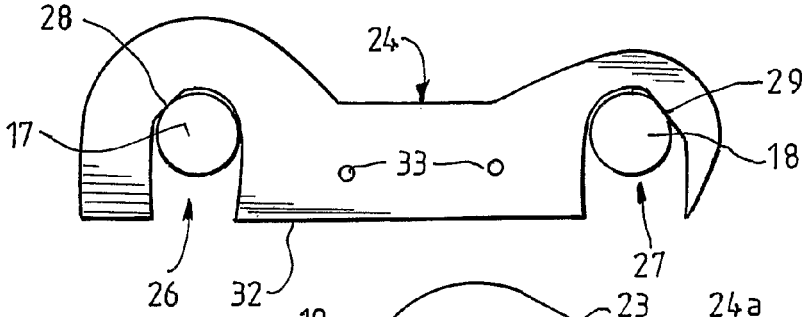
FIG. 6 is an elevational view of a locating plate engaged with a pair of mounting pins.

The locating plate 24 of FIG. 6 is provided with a pair of slots 26, 27 which are adapted to engage the respective pins 17, 18. The slots have a substantially circular end with which the pins 17 and 18 engage, and the spacing between the slots 26 and 27 defines the desired spacing of the pins 17 and 18.

The slots 26 and 27 on the locating plate 24 may each be formed with a location surface 28, 29 which is used to guide the locating plate 24 into position and cause any necessary relative alignment movement between the pins 17 and 18 towards or away from each other as the locating plate 24 engages with the pins 17 and 18.

The locating plate 24 has a locating surface 32 adapted to engage an upper surface of the bucket 10 or ripper 15 or other implement with which the embodiments are used. The locating surface 32 ensures that the locating plate 24 is in the correct position and orientation to properly locate the pin 17. The locating plate 24 has one or more holes 33 to receive bolts or the like (not shown) that pass through cooperating holes in the respective ears 12 and 13, by which the locating plate 24 is held in position relative to the respective ear 12 and 13.

Figure 4:
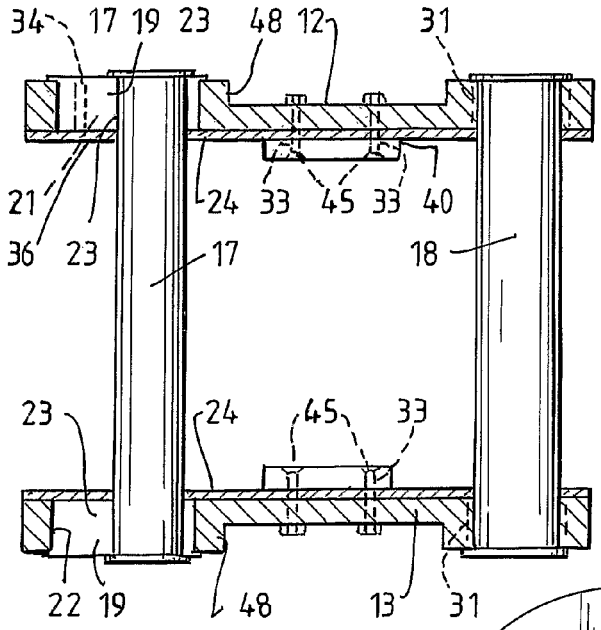
FIG. 4 is a cross sectional plan view of the embodiment of FIG. 3 taken along the lines 4-4 of FIG. 3.

As seen in FIGS. 4 and 5, it is preferred that a locating plate 24 is provided adjacent each ear 12, 13 to correctly align the pin 17 and to ensure that the pin receptor 19 on each ear 12, 13 is in the correct position. The locating plates 24 may be of any suitable thickness commensurate with the dimensions of the mounting on the excavator arm and the ear spacing. In this regard, a plurality of locating plates 24 will be required to take account of differing pin centre spacing and mounting widths. However, it is much more convenient to provide a plurality of locating plates 24 than to provide a similar number of different buckets or other implements. Alternatively, a spacer block 40 may be mounted to the locating plates by the attachment bolts or other fasteners 45 to provide the desired spacing for an excavator arm that has a transverse dimension substantially less than the dimension between facing surfaces of the locating plates 24, when in position. Such spacer blocks 40 are preferably provided on both ears 12 and 13.

Figure 7:
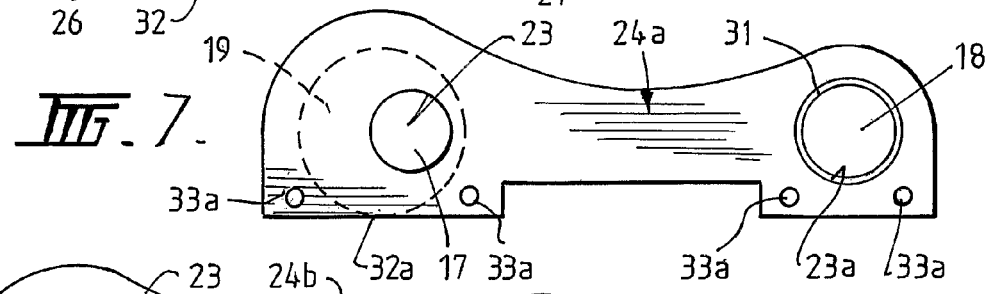
FIG. 7 illustrates a modified form of locating plate.

FIG. 7 illustrates a modified form of locating plate 24*a* having a pin receiving hole 23 which is spaced the minimum distance from the pin hole 23*a*. The locating plate 24*a* has locating surfaces 32*a* along its lower edge which are adapted to closely engage the upper surface of the bucket 10 or ripper 15 or other implement with which the embodiment is used. The locating surfaces 32*a* ensure that any tendency for the pin receptor 19 to rotate about the axis thereof due to forces applied, in use, to the pin 17 is resisted. If desired, holes 33*a* may be provided in the locating plates 24*a* to receive securing bolts or other fasteners or the like to secure the locating plates 24*a* in position.

Figure 8:
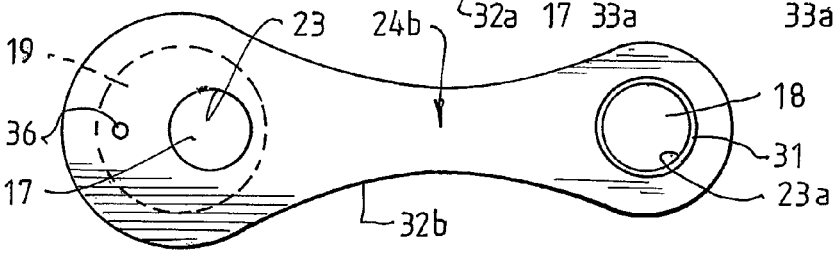
FIG. 8 is an elevational view of a further modification of a locating plate.

FIG. 8 is a view of a further modification of a locating plate 24*b* for use with implements having a configuration the top wall between the ears which is non-linear, or is curved. With this arrangement, the locating surface 32*b* matches the curve of the implement top wall.

An additional locking is provided by a hole 34 in the pin receptor 19 spaced from the axis thereof, and a corresponding hole 36 in the locating plate 24*b*, the holes, when aligned, being adapted to receive a bolt or other fastener (FIG. 4) to lock the pin receptor 19 to the locating plate 24*b*. With this arrangement, the pin receptor 19 is prevented from moving, ie., rotating about its axis.

In the embodiments of FIGS. 7 and 8, the locating plates 24*a* and 24*b* are formed with holes 23, 23*a* in place of the slots 26, 27 shown in FIG. 6. The holes 23, 23*a* are of a diameter to closely receive the pins 17, 18, associated with the particular excavator arm to which the implement is to be mounted. Alternatively, sleeves or bushes 31 may be fitted to the pins to enable them to fit a variety of buckets, rippers or other implements having a variety of hole sizes in the ears thereof.

It will be understood that a number of different pin receptors 19 may be provided having the pin opening 23 of the appropriate diameter to receive the correct diameter pin 17 for the particular implement. Thus, for a CAT excavator, the diameter of the pin opening will be such as to receive a 65 mm pin 17 whereas a commensurate Komatsu implement will have a pin receptor having a pin opening to receive a 65 mm diameter pin 17.

Figure 9:
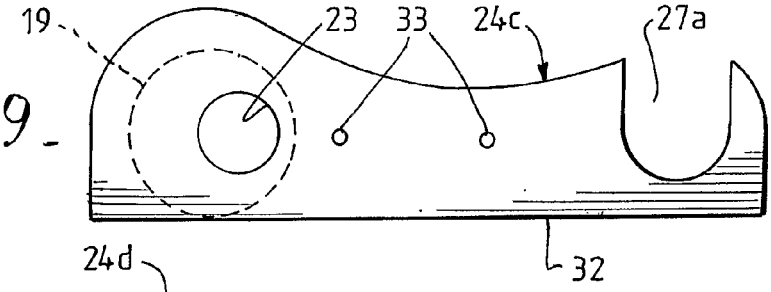
FIG. 9 is an elevational view of another embodiment of a locating plate

Referring to FIG. 9, a modified form of locating plate 24*c* has a slot 27*a* at one end and a pin opening 23 at the other end. Two holes 33 are also provided to enable the plate 24*c* to be fastened to a bucket ear 12, 13. The dotted line indicates the position of the pin receptor 19.

Figure 10:
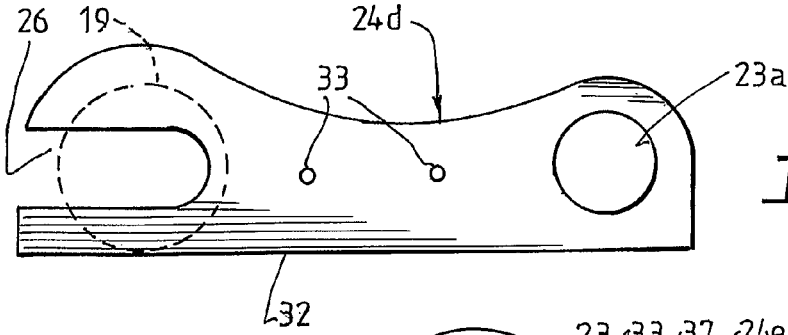
FIG. 10 is an elevational view of another embodiment of a locating plate

FIG. 10 illustrates a further modification of locating plate 24*d* having a pin opening 23*a* at one end and a front-opening, pin receiving slot 26 at the other end. The plate 24*d* has two holes 33 to receive bolts to fasten the plate 24*d* to a bucket ear 12, 13.

Figure 11:
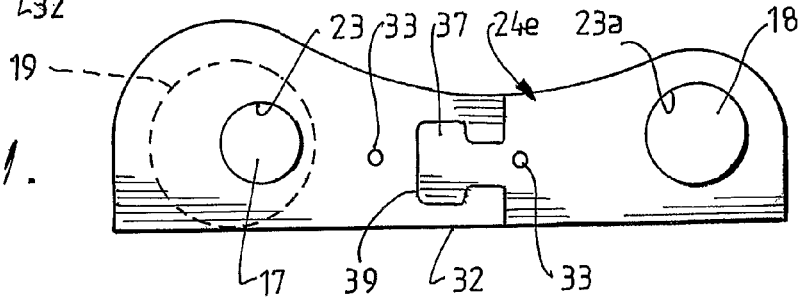
FIG. 11 is an elevational view of another embodiment of a locating plate

FIG. 11 illustrates a further modification of locating plate 24*e* formed of two parts which are adapted to be inter-engaged by a shaped tongue 37 engaging with a cooperating slot 39. The plate 24*e* has a pin opening 23*a* in a rear part to engage with the pin 18 and a second pin opening 23 in the front part to engage the pin 17. The plate 24*e* has two holes 33 to receive bolts to fasten the plate 24*e* to a bucket ear 12, 13. With this arrangement, the rear part of the plate 24*e* may be a common part to which may be attached one of a number of front parts each having a different positioning of the pin opening 23 to allow the plate 24*e* to be used with a variety of implement arms.

Figure 12:
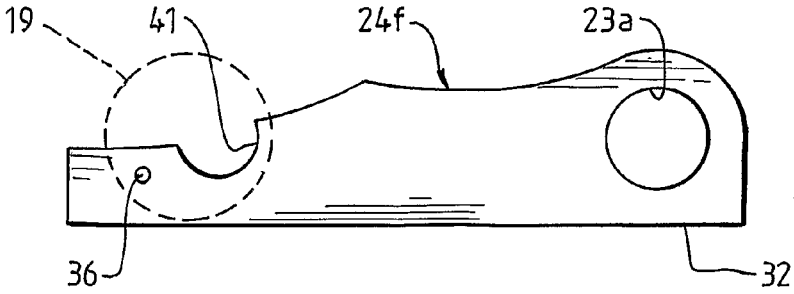
FIG. 12 is an elevational view of another embodiment of a locating plate

FIG. 12 illustrates a further modification of locating plate 24*f* having a pin opening 23*a* at one end and a shaped, top-opening, pin receiving cut-away 41 at the other end. An additional locking is provided by a hole 34 in the pin receptor 19 spaced from the axis thereof, as previously described with reference to FIG. 8, and a corresponding hole 36 in the locating plate 24*f*, the holes, when aligned, being adapted to receive a bolt or other fastener to lock the pin receptor 19 to the locating plate 24*f*. With this arrangement, the pin receptor 19 is prevented from moving, ie., rotating about its axis. It will be appreciated that the pin holes 23*a* may be formed as elongated holes or slots. Alternatively, the corresponding holes 16 may be elongated.

Figure 13:
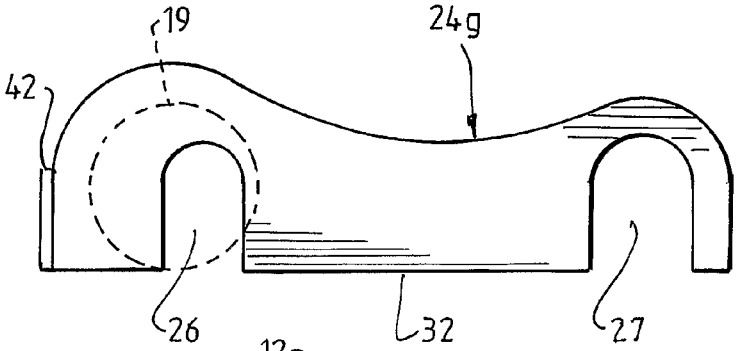
FIG. 13 is an elevational view of another embodiment of a locating plate
Figure 14:
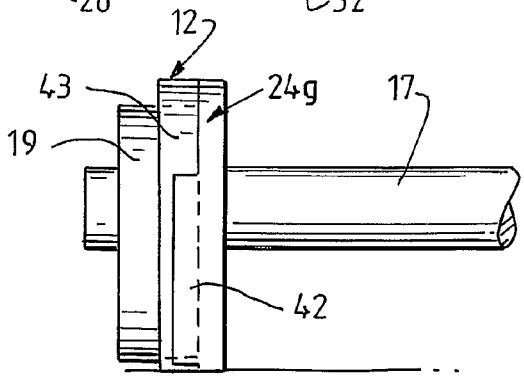
FIG. 14 is an end elevational view of the locating plate of FIG. 13 engaged with a bucket ear.

The embodiment of locating plate 24*g* shown in FIGS. 13 and 14 is similar to that shown in FIG. 6, having the two downwardly extending slots 26 and 27 adapted to engage the pins 17 and 18, respectively. The plate 24*g* of this embodiment, however, is provided with a transversely extending locking flange 42 adapted to engage the forward edge 43 of the ear 12, The flange 42 forms a locating surface in addition to or separately from the locating surfaces 32.

Figure 15:
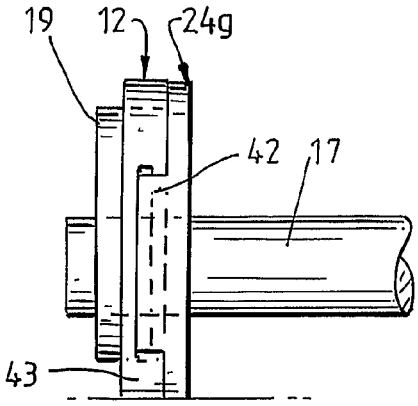
FIG. 15 is an end elevational view of another embodiment of a locating plate engaged with a bucket ear.
Figure 16:
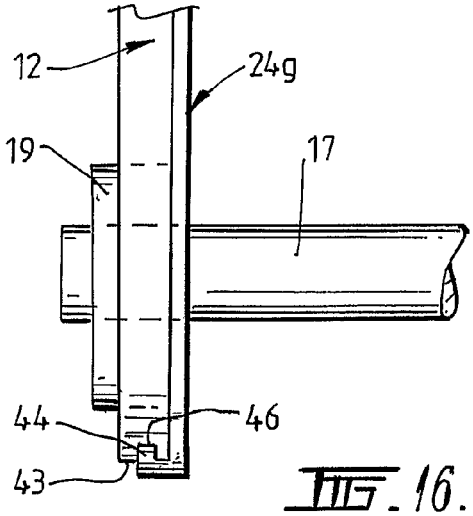
FIG. 16 is a top plan view of the ear, locating plate and pin of FIG. 15.

FIGS. 15 and 16 illustrate a further variation in which the flange 42 has a reversely turned portion 44 that engages in a recess or slot 46 in the front edge 43 of the ear 12 to ensure that the plate 24*g* is held against the inside surface of the ear 12.

The mounting system of the present invention may be used for earthmoving and excavator equipment attachments of a wide range of class sizes from relatively small, such as 7*t* up the larger 40*t* class of implement. By using the pin receptor mounting 19 with the eccentric pin receptor opening 23 to adjust the pin position and spacing, and by using different diameter openings in the receptor 19 together with a pin sleeve bush 31 also with different diameter holes to receive different diameter pins, a full range of adjustability of the mounting is obtained so that an implement may be used with a wide range of different machines.

It will be seen that, in the embodiments illustrated, the locating plates 24 engage against the inner surfaces of each respective ear 12 and 13 to effectively increase the thickness of the respective ears. the ears may be formed with a boss 48 coaxial with the enlarged opening or hole 21, 22 to enhance the structural strength of the ears adjacent the holes 21 and 22.

The locating plate may be formed with a laterally extending projection or spigot adapted to engage with the pin receptor 19 to prevent rotation thereof.

A combination of spacer blocks 40 held against the locating plates 24 by bolts or fasteners 45 through the holes 33, and the locking bolt through the hole 34 in the pin receptor 19 and the hole 36 in the plate 24, may be used in some embodiments. Similarly, holes 33*a* may be used in many forms of the invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A mounting system for a heavy machinery implements, the system comprising:

a pair of spaced mounting ears extending from the implement, the ears having aligned pairs of holes to receive axially spaced, parallel mounting pins adapted to be engaged by an operating arm of the heavy machinery;

a mounting pin receptor engaged in each of at least one aligned pair of holes, the pin receptors each having an eccentric pin receptor hole to receive one of the mounting pins therethrough when the pin receptor holes are aligned, the pin receptors being rotatable about their axes to thereby vary relative to the ears the position of a mounting pin engaged with the pin receptor holes; and a locating plate to be secured relative to the implement or one of the ears, the locating plate being engageable with said one mounting pin and defining a locking aperture, wherein said one mounting pin is received in the locking aperture to fix the position of said one mounting pin relative to the ears when said locating plate is secured to the implement or one of the ears.

2. A mounting system according to claim 1, wherein the locating plate has at least one locating surface adapted to engage a cooperating surface on the implement or on one of the ears.

3. A mounting system according to claim 2, wherein the at least one locating surface abuts the cooperating surface of the implement along a length of the locating plate to assist in retaining the locating plate in position relative to the ear.

4. A mounting system according to claim 1, wherein the locating plate is formed with a least one transversely extending flange to engage a respective ear.

5. A mounting system according to claim 4, wherein an edge of the respective ear with which the locating plate is engaged is formed with a recess to receive a reversely turned rib or projection extending from a transverse flange on the respective locating plate.

6. A mounting system according to claim 2, further comprising a kit of interchangeable locating plates each having a pin receptor hole in a position relative to the one or more locating surfaces which varies between locating plates to thereby vary the relative position of the said one mounting pin engaged with the respective locating plates.

7. A mounting system according to claim 1, wherein the locating plate is engaged with the two mounting pins.

8. A mounting system according to claim 7, wherein the locating plate has holes or slots to closely engage the respective mounting pins to thereby lock them in a predetermined spaced relationship to correspond with the desired position to receive an operating arm from a particular machine.

9. A mounting system according to claim h wherein the locating plate is engaged with an inner surface of a respective ear.

10. A mounting system according to claim 1, wherein a locating plate is provided for engagement with each ear of the implement.

11. A mounting system according to claim 1, wherein the locating plate has a thickness selected to accommodate different widths of arm mounting structures and ear spacings.

12. A mounting system according to claim 1, further comprising a kit of pin receptors, each having pin receptor holes of different diameters so that pins of a different diameter may be fitted to the ears.

13. A mounting system according to claim 1, wherein a changeable sleeve bush is engaged with mounting pins of different diameters to fit the pin receptor.

14. A mounting system according to claim 1, wherein the pin receptors define a securing hole therethrough parallel to the eccentric pin receptor hole, the securing hole being adapted to receive a bolt or other fastener, the bolt or fastener being adapted to also engage through a corresponding hole in the associated locating plate so as to lock the pin receptor to the locating plate.

15. A mounting system according to claim 2, wherein the locating plate has one or more holes adapted to align with corresponding holes in the respective ear to receive bolts or the like to secure the locating plate to the ear with the pins in the position determined by the eccentric pin receptor holes and locating surfaces.

16. A mounting system for a heavy machinery implement, the system comprising:

a pair of spaced mounting ears extending from the implement, the ears having aligned pairs of holes to receive axially spaced, parallel mounting pins adapted to be engaged by an operating arm of the heavy machinery;

a mounting pin receptor engaged in each of at least one aligned pair of holes, the pin receptors each having an eccentric pin receptor hole to receive one of the mounting pins therethrough when the pin receptor holes are aligned, the pin receptors being rotatable about their axes to thereby vary relative to the ears the position of a mounting pin engaged with the pin receptor holes;

a locating plate to be secured relative to the implement or one of the ears, the locating plate being engageable with said one mounting pin and defining a locking aperture; and an implement arm spacer block positioned intermediate the mounting pins and fastened to the locating plate and one ear by bolts, wherein said one mounting pin is received in the locking aperture to fix the position of said one mounting pin relative to the ears when said locating plate is secured to the implement or one of the ears.

17. A mounting system for a heavy machinery implement, the system comprising:

a pair of spaced mounting ears extending from the implement, the ears having aligned pairs of holes to receive axially spaced, parallel mounting pins adapted to be engaged by an operating arm of the heavy machinery;

a mounting pin receptor engaged in each of at least one aligned pair of holes, the pin receptors each having an eccentric pin receptor hole to receive one of the mountings therethrough when the pin receptor holes are aligned, the pin receptors being rotatable about their axes to thereby vary relative to the ears the position of a mounting pin engaged with the pin receptor holes; and a locating plate to be secured relative to the implement or one of the ears, the locating plate being engageable with said one mounting pin and defining a slot adapted to engage with one of the mounting pins to fix the position of said one mounting pin relative to the ears when said locating plate is secured to the implement or one of the ears, wherein each slot has a location surface to guide the locating plate into position and cause any necessary relative alignment movement between the pins towards or away from each other as the locating plate engages with the pins.

18. A mounting system according to claim 1, wherein a pin receptor is engaged in each of the aligned pair of holes in the ears, the pin receptors each having an eccentric pin receptor hole to receive a respective one of the mounting pins therethrough when the pin receptor holes of the respective pair are aligned, the pin receptors being rotatable about their axes to thereby vary relative to the ears the position of the mounting pins engaged with the respective pin receptor holes, and a locating plate engageable with both the said mounting pins.

19. A mounting system according to claim 1, wherein the locating plate has a transversely extending spigot adapted to engage with the pin receptor to prevent rotation thereof.

20. A mounting system according to claim 16, wherein the locating plate has at least one locating surface adapted to engage a cooperating surface on the implement.

21. A mounting system according to claim 20, wherein the at least one locating surface abuts the cooperating surface of the implement along a length of the locating plate to assist in retaining the locating plate in position relative to the ear.

* * * * *